US007555982B2

(12) United States Patent
Telljohann

(10) Patent No.: US 7,555,982 B2
(45) Date of Patent: Jul. 7, 2009

(54) METHOD AND DEVICE FOR SUPPLYING PRINTING INK TO AND CARRYING IT OFF FROM A DOCTOR BLADE DEVICE OF THE INKING SYSTEM OF A ROTARY PRINTING PRESS AND/OR FOR CLEANING THE DOCTOR BLADE DEVICE

(75) Inventor: Lutz Telljohann, Lengerich (DE)

(73) Assignee: Windmoeller & Hoelscher KG, Lengerich (DE)

( * ) Notice: Subject to any disclaimer, the term of this patent is extended or adjusted under 35 U.S.C. 154(b) by 29 days.

(21) Appl. No.: 10/516,526

(22) PCT Filed: May 30, 2003

(86) PCT No.: PCT/EP03/05788

§ 371 (c)(1),
(2), (4) Date: Dec. 2, 2004

(87) PCT Pub. No.: WO03/103964

PCT Pub. Date: Dec. 18, 2003

(65) Prior Publication Data

US 2006/0114303 A1 Jun. 1, 2006

(30) Foreign Application Priority Data

Jun. 10, 2002 (DE) ..... 102 25 681

(51) Int. Cl.
*B41F 31/02* (2006.01)
*B41F 31/00* (2006.01)

(52) U.S. Cl. ..... 101/366; 101/350.6

(58) Field of Classification Search ..... 101/366, 101/350.6, 364

See application file for complete search history.

(56) References Cited

U.S. PATENT DOCUMENTS 4,479,433 A * 10/1984 MacPhee et al. ..... 101/364
4,643,124 A 2/1987 Switall
5,088,402 A * 2/1992 Hycner et al. ..... 101/142

(Continued)

FOREIGN PATENT DOCUMENTS

DE 195 48 535 A1 7/1997

(Continued)

*Primary Examiner*—Anthony H Nguyen
*Assistant Examiner*—Leo T Hinze
(74) *Attorney, Agent, or Firm*—Jacobson Holman PLLC

(57) ABSTRACT

A process and a device supply printing ink to and remove link from a doctor blade device of the inking system of a rotary printing press. The device has a doctor blade support provided with a linearly extending groove and with doctor blades that are contacted with an inking roller or screen roller, the blades forming together with the inking roller and the groove an inking chamber. The device has conduits and motor-driven pump devices that supply ink to and remove ink from the inking chamber. The motors are preadjusted in terms of their parameters and are not modifiable during operation. A portion of the ink from the flow of ink supplied to the doctor blade device can be diverted to an ink supply source, and/or a portion of the ink from the flow of ink removed from the doctor blade device can be returned to the ink supply conduit.

24 Claims, 2 Drawing Sheets

U.S. PATENT DOCUMENTS

Figure 1:
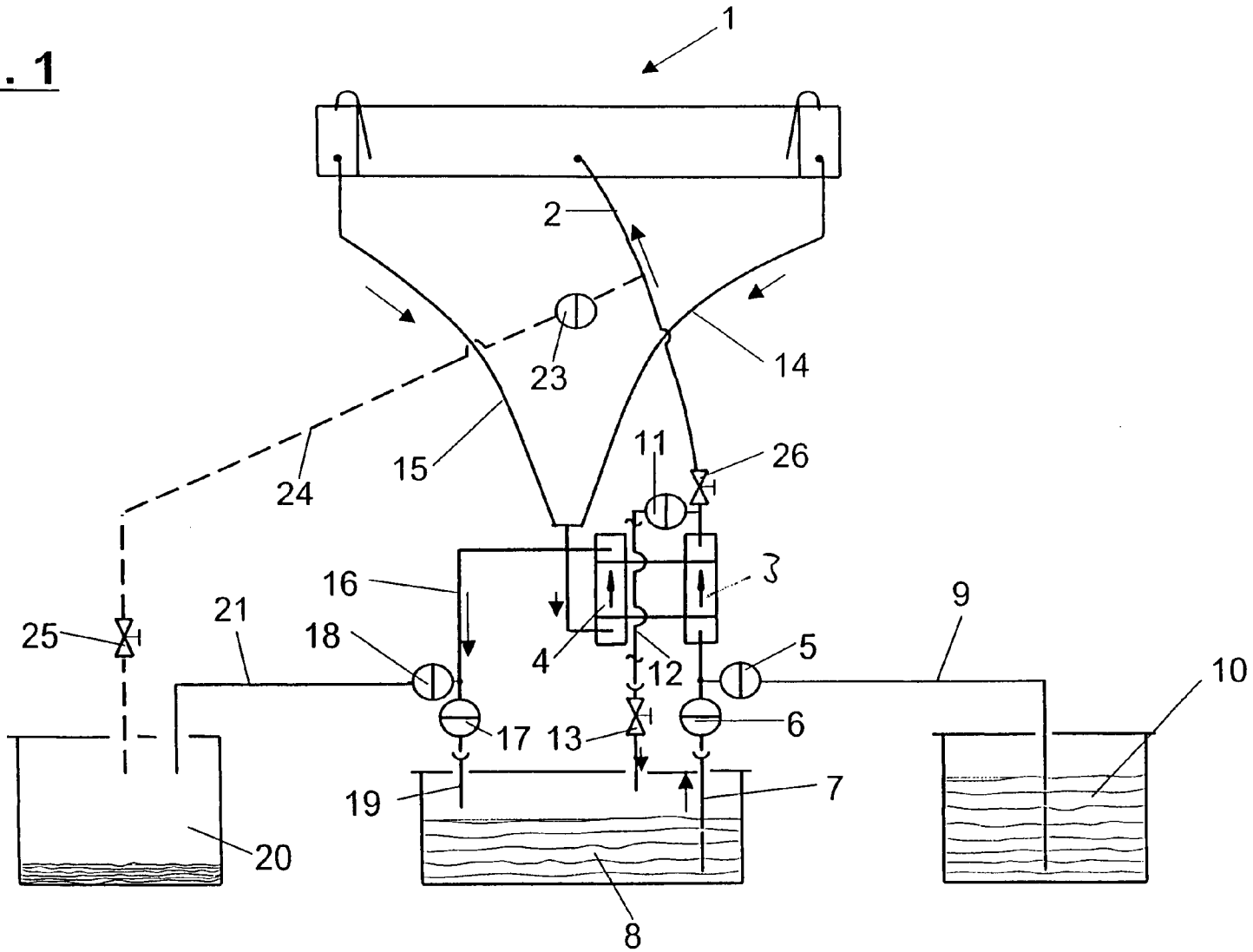

| | | | | |
|---|---|---|---|---|
| 5,683,508 | A * | 11/1997 | Bleiler et al. | 118/46 |
| 5,816,163 | A * | 10/1998 | Achelpohl et al. | 101/483 |
| 6,698,353 | B2 * | 3/2004 | Chou et al. | 101/349.1 |
| 6,857,367 | B2 * | 2/2005 | Heller et al. | 101/483 |
| 7,165,494 | B2 * | 1/2007 | Shields | 101/483 |
| 2003/0084805 | A1 * | 5/2003 | Heller et al. | 101/425 |

FOREIGN PATENT DOCUMENTS

| | | | |
|---|---|---|---|
| DE | 197 57 094 | A1 | 6/1999 |
| EP | 0 461 426 | B1 | 12/1991 |
| EP | 0 765 747 | B2 | 4/1997 |
| EP | 0 958 920 | A1 | 11/1999 |
| GB | 2 332 394 | A | 6/1999 |

* cited by examiner

METHOD AND DEVICE FOR SUPPLYING PRINTING INK TO AND CARRYING IT OFF FROM A DOCTOR BLADE DEVICE OF THE INKING SYSTEM OF A ROTARY PRINTING PRESS AND/OR FOR CLEANING THE DOCTOR BLADE DEVICE

This is a nationalization of PCT/EP03/05788 filed May 30, 2003and published in German.

BACKGROUND OF THE INVENTION

1. Field of Invention

The invention concerns a process and a device for supplying printing ink to and educing printing ink from a squeegee device of an inking system on a rotary printing press and for cleaning the squeegee device, which comprises a squeegee blade carrier, provided with a longitudinally running trough, with squeegee blades that are adjustable on a form inking roller that, together with the form inking roller and the trough, delimit an ink chamber, and comprise lines and pumping devices powered by motors for supplying and educing the ink or the cleaning agent into and out of the ink chamber.

2. Description of the Prior Art

A device of this type is known from the German patent DE 195 48 535 C2 with which residual ink can be removed not only from the ink chamber of the squeegee device, but also from the supply and evacuation lines while reducing the amount of dissolving agent used for cleaning, in that the ink from the ink chamber is pumped back into an ink tank via the evacuating lines, in that the dissolving agent is subsequently pumped out of a dissolving agent tank via the supply lines into the ink chamber and is channeled via the evacuating lines into the ink tank for a predetermined amount of time, in that admission into the ink tank is subsequently stopped and in that the dissolving agent still soiled by the ink is pumped into a waste tank for a predetermined amount of time, in that the supply flow of dissolving agent from the dissolving agent tank is subsequently interrupted and in that the dissolving agent still present in the circulation system is pumped into the waste tank as well, in that fresh dissolving agent is subsequently pumped via the supply lines and educing lines in a closed cleaning circuit for a predetermined amount of time and in that finally, the dissolving agent that was fed through the closed cleaning circuit is channeled into the waste tank. The known device is elaborate to the extent that an ink pump, a dissolving agent pump and two mutually connected pumps are provided for pumping ink and dissolving agent back into the ink tank or into the waste tank. The use of several pumps creates high procurement costs on the one hand.

On the other hand, it must be taken under consideration in the case of the known device that during the circulation of the ink under printing operations, a larger volume must be fed back into the ink tank than is being pumped into it, since the ink in the ink chamber becomes enriched with air. As a consequence of this, the evacuating (i.e., return) pump must pump a larger volume than the delivery (i.e., feed) pump. This volumetric pumping ratio must be permanently monitored and readjusted manually when required.

SUMMARY OF THE INVENTION

The task of the present invention is therefore to propose a process and a device of the type initially indicated, which can manage with a number of pumps for circulating the ink and/or for cleaning with a dissolving agent or cleaning agent and for which it is not required to readjust the volumetric pumping ratio.

This task is resolved in accordance with the invention as described herein, in which a portion of the ink stream that is supplied to the squeegee device is diverted to the ink supply tank, and/or a portion of the ink stream that is returned from the squeegee device is diverted to the ink supply line.

Furthermore, this task is also resolved for a device of the type initially indicated in that two pumping devices are provided that are preset in their parameters, and that, when required, a portion of the ink from the ink stream supplied to the squeegee device is channeled off and/or a portion of the ink from the ink stream led away from the squeegee device is rechanneled to the squeegee device.

The underlying task of the invention is also resolved for a device of the type initially indicated in that two pumping devices are provided, of which the first pumping device, via regulating valves, suctions off ink or cleaning agent from an ink reservoir or from a cleaning agent reservoir, and pumps it into the ink chamber, and of which the second pumping device pumps an ink-air mixture from the ink chamber into the ink reservoir, or pumps cleaning agent or cleaning agent containing ink into a waste reservoir containing used cleaning agent, and that, via a regulating valve, the supply line stands in connection with a line leading to the ink reservoir, in which an adjustable throttle valve or throughflow regulating valve is arranged.

As compared to the known device, the process in accordance with the invention and the device in accordance with the invention make it possible to circulate the ink during printing operations and to clean the squeegee device with only two pumps. In order to be able to provide two pumping capacity devices according to the invention with an established efficiency ratio, then in accordance with the invention, at least one bypass must be provided that comprises a line branching out from the feed lines. Purposefully, the out-branching line channels the ink directly back into the ink tank.

Given the case, that the vacuum (i.e., return) pump has a greater pumping capacity than the priming (i.e., feed) pump, in addition to the first bypass or in place of the first bypass, it is advantageous to provide a line that leads from the pressure (i.e., discharge) side of the vacuum pump to the supply line of the squeegee chamber.

Advantageously, the bypass line branching out from the feed line and/or the line leading from the pressure side of the eduction (i.e., return) pump to the supply side of the squeegee chamber are each respectively equipped with a cutout valve and/or with a through low regulating valve. The through low regulating valves are empirically adjusted in such a manner that, for example, a portion of the ink supplied by the priming pump is immediately recirculated into the ink tank or that the ink drawn off by the vacuum (i.e., return) pump is made available anew to the supply side of the squeegee chamber. In this manner, it is generally ensured during printing operations that the eduction volumes and the feed volumes, and the volumes supplied to and drawn off from the ink chamber are about equal, while taking under consideration the circumstance that, in the ink chamber, the ink becomes enriched with air.

It is especially advantageous if the fill level of the ink in the squeegee chamber is monitored by a sensor and, in the event that the specified fill levels are exceeded or not attained, the throttle valves or the throughflow regulating valves are set in such a manner, via a regulated circuit, so that the fill level will again resume its status within the specified limits.

According to an especially preferred embodiment of the invention, it is provided that the two pumping devices comprise two chambers of a double diaphragm pump with only one drive shaft. Such double diaphragm pumps with separate chambers, of which the one can provide delivery and the other can provide recirculation, are sold, for example, by ALMATEC Maschinenbau GmbH, in D-47475 Kamp-Lintfort. Advantageously, the two chambers of the double diaphragm pump have the same volumetric pumping capacity.

Furthermore, the feed line can be provided with a line leading to the waste tank, which features a valve and a throttle valve or a throughflow regulating valve. This line is a bypass line, through which cleaning agent pumped into the squeegee chamber during cleaning of the squeegee device can be recirculated, in order to take the circumstance into account, that during the cleaning process, the cleaning agent also becomes enriched with air so that, during the cleaning process, the volume that was recirculated out of the squeegee chamber is greater than the volume that was pumped in. Since the cleaning agent that was recirculated via the bypass line is not soiled or barely soiled, it can be advantageous to let the bypass line flow into the tank for clean cleaning agent.

Exemplary embodiments of the invention shall be more closely detailed in the following by the use of drawings, in which the device in accordance with the invention for supplying and educing printing ink to and from a squeegee device of an inking system on a rotary printing press and for cleaning the squeegee device is schematically represented.

BREIF DESCRIPTION OF THE DRAWINGS

Figure 2:
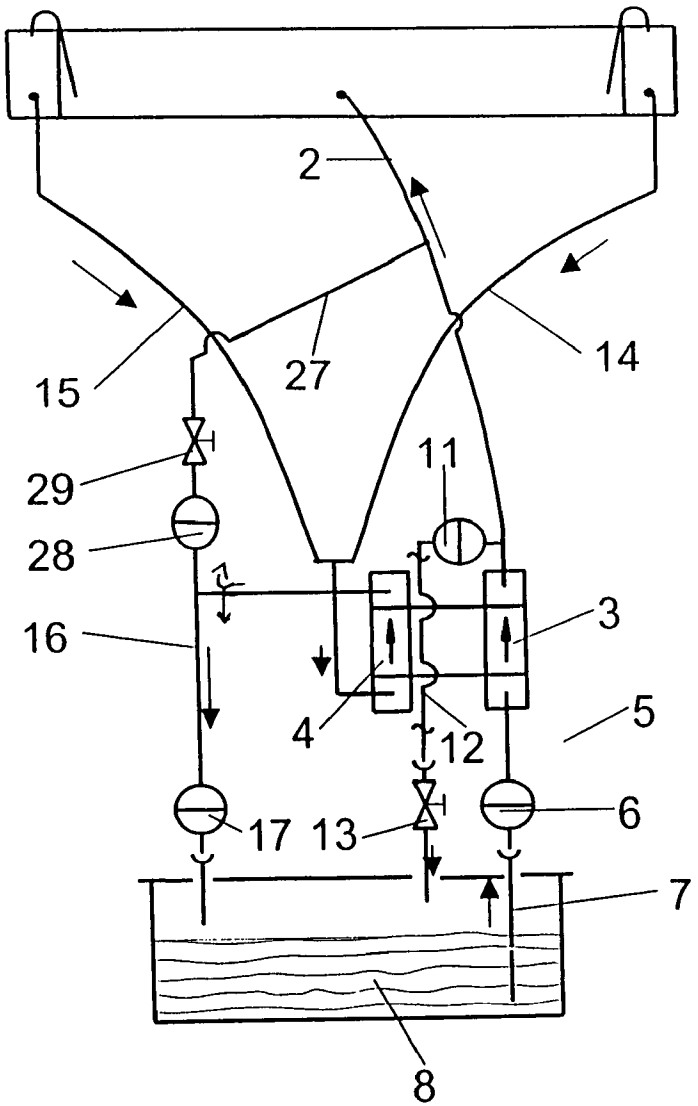

The individual figures show:

FIG. 1 Schematic representation of the device with bypass devices on the supply side FIG. 2 Schematic representation of the device with a bypass device on the eduction side

DETAILED DESCRIPTION OF THE PREFERRED EMBODIMENTS

In FIG. 1, the device shown in accordance with the invention is designed for the case in which the pumping capacity of the pump chamber 3 is equal to or greater than the pumping capacity of the pump chamber 4. Into the central section of the ink chamber, which is a component part of the squeegee device 1, a feed line 2 flows that is connected to the delivery (i.e., discharge) side of a pump chamber 3 of the double diaphragm pump 3, 4. The suction side of the pump chamber 3 of the double diaphragm pump 3, 4 can, via the line shutoff valves or the cutout valves 5, 6, either be connected to the suction line 7, which flows from the ink tank 8, or connected to the suction line 9, which flows from the tank 10 for clean cleaning agent.

Connected to the feed line 2, via the line shutoff valve or the cutout valve 11, is a line 12, in which an adjustable throttle valve or through low regulating valve 13 is arranged. A throttle valve 26 can also be provided in the feed line 2.

The suction side of the second pump chamber 4 of the double diaphragm pump 3, 4 is connected to the recirculation lines 14, 15, which are connected on the sides of the ink chamber of the squeegee device 1. The pressure side of the second pump chamber 4 of the double diaphragm pump 3, 4 is connected to a line 16, which, via line shutoff valves or cutout valves 17, 18, can be connected to a line 19 leading to the ink tank 8, or can be connected to a line 21 that flows into the waste tank 20 for used cleaning agent.

Another line 24 can be connected, via the line shutoff valve or the cutout valve 23, to the feed line 2, in which an adjustable throttle valve or throughflow regulating valve 25 is arranged and which flows into the waste tank 20.

Upon starting the printing operation and during the printing operation, valve 5 finds itself closed in its basic state. Via the suction line 7 and via valve 6, which is open in its basic state, ink is delivered into the ink chamber of the squeegee device 1 through the pump chamber 3 of the double diaphragm pump 3, 4 and through the feed line 2. During the printing operation, printing ink or printing ink enriched with air is pumped back into the ink tank 8 via the recirculation lines 14, 15 and via the second pump chamber 4 of the double diaphragm pump 3, 4, via the line 16 and the valve 17, with valve 18 being closed. Since the pump chamber 3 of the double diaphragm pump 3, 4 has an equal or greater volumetric capacity than pump chamber 4, and the recirculated ink, in spite of the reduction in ink due to the material printed, exhibits a greater volume due to its enrichment with air than does the ink delivered through the feed line 2, a partial quantity of the printing ink is pumped back, during the printing operation, into the ink tank 8 with valve 11 open and through line 12 and through the throttle valve 13, so that the pumping ratio between the two pump chambers 3, 4 matches the volumes pumped.

When cleaning the ink chamber and the lines channeling the printing ink, the valve 6 is closed, and while valve 5 is open, via the line 9, clean cleaning agent is suctioned from tank 10 and is channeled into the ink chamber via the feed line 2, with valve 11 closed. During this cleaning process, initially, the ink that can still be displaced by the cleaning agent via valve 17 and via line 19, with valve 18 closed, is channeled into the ink tank 8. However, as soon as the ink is diluted by the solvent, valve 17 is closed and valve 18 is opened, and the cleaning agent or solvent rendered impure with the ink is channeled into the waste tank 20 via line 21. Since the cleaning agent also becomes enriched with air in the ink chamber during the cleaning process, a line 24 can be connected to the feed line 2 via valve 23, in which the adjustable throttle and through low regulating valve 25 is arranged and which flows into the waste tank 20. As soon as this occurs, cleaning agent can be channeled into the waste tank via this line 24 in order to take the circumstance into account that the cleaning agent that is recirculated through lines 14, 15 is enriched with air. To the extent that clean cleaning agent could be branched out from the feed line 2, line 24 could also be made to flow into the tank 10 for clean cleaning agent.

FIG. 2 shows another preferred form of embodiment of the invention, wherein the representation of the cleaning agent tank and of the cleaning agent lines has been omitted for reasons of gaining a clear overview. In the event that pump chamber 4 of the double diaphragm pump 3, 4 should display a volumetric capacity that is substantially greater than pump chamber 3, a portion of the ink pumped out from feed line 2 must be led back through the recirculation line 27. A throttle valve or a throughflow regulating valve 29 is provided for regulating the return flow. Furthermore, another cutout valve 28 can be provided that is closed when the ink is to be pumped out of the ink chamber.

Of course, the bypass 27, 28, 29 represented in FIG. 2 can also be integrated into the device in accordance with FIG. 1.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A process for supplying printing ink to and educing printing ink from a squeegee device of an inking system on a rotary printing press that has a squeegee blade carrier, provided with a longitudinally running trough, with squeegee blades that are adjustable on a form inking roller or on an anilox roller, which, together with the form inking roller and the trough provide an ink chamber, and has lines and first and second pumping devices powered by motors for supplying and educing the ink to and from the ink chamber, comprising presetting pump operational parameters of the motors such that a flow rate ratio between the first pumping device and the second pumping device is fixed and on demand diverting from an ink feed line that feeds the ink from an ink tank to the squeegee device a portion of the feed ink and/or diverting from an ink return line that removes the ink from the squeegee device a portion of the return ink, the feed ink being diverted through a bypass line that departs from the feed line and leads directly to the ink tank, and the return ink being diverted through a bypass line that departs from the return line and connects to the feed line of the squeegee device.

2. The process in accordance with claim 1, further comprising regulating flow with a throughflow regulating valve and/or a cutout valve provided in at least one of the feed line and the bypass line.

3. The process in accordance with claim 2, further comprising monitoring with a sensor a quantity of the ink present in the squeegee device and signaling a closed loop control circuit that regulates the throughflow regulating valve such that the quantity of ink circulating in the squeegee device is maintained within specified limits.

4. The process in accordance with claim 1, wherein the first and second pumping devices are each a chamber of a double diaphragm pump driven by a single drive shaft.

5. The process in accordance with claim 4, wherein a first chamber is an ink feed chamber and a second chamber is an ink return chamber.

6. The process in accordance with claim 5, wherein the ink feed chamber has a volumetric capacity that is equal to a volumetric capacity of the ink return chamber.

7. The process in accordance with claim 5, wherein the ink feed chamber has a volumetric capacity that is greater than a volumetric capacity of the ink return chamber.

8. The process in accordance with claim 5, wherein the ink return chamber has a volumetric capacity that is greater than a volumetric capacity of the ink feed chamber.

9. The process in accordance with claim 1, wherein a volumetric flow rate of the return ink that is removed from the squeegee device is greater than a volumetric flow rate of the feed ink on a discharge side of the pumping device that pumps the feed ink.

10. The process in accordance with claim 9, wherein the return ink that is removed from the squeegee device is enriched with air.

11. The process in accordance with claim 1, wherein a volume of the feed ink that is diverted from the ink feed line is such that the flow rate ratio corresponds to a volume pumped by the pumping devices.

12. The process in accordance with claim 1, wherein the step of diverting the portion of the feed ink or the step of diverting the portion of the return ink is performed during the inking operation of the squeegee device.

13. The process in accordance with claim 1, wherein the return line leads to the ink tank.

14. A device that delivers ink to and from a closed squeegee device of a rotary printing unit inking system, comprising:

a first and a second pumping device in which a flow rate ratio between the first pumping device and the second pumping device is fixed;

a first bypass line configured to controllably divert from an ink feed line that feeds the ink from an ink tank to the squeegee device a portion of the feed ink, the first bypass line departing from the ink feed line and leading directly to the ink tank; and a second bypass line configured to controllably divert from an ink return line that removes the ink from the squeegee device a portion of the return ink, the second bypass line departing from the return line and connecting to the feed line of the squeegee device.

15. The device according to claim 14, wherein the first bypass line departs from the ink feed line on a discharge side of the first pumping device and communicates the diverted feed ink to the ink tank that is in communication through an ink suction line with a suction side of the first pumping device.

16. The device according to claim 14, wherein the second bypass line departs from the return line on a discharge side of the second pumping device and communicates the diverted return ink to the ink feed line at a location between the first bypass line and the squeegee device.

17. The device according to claim 14, wherein the first pumping device is an ink feed chamber and the second pumping device is an ink return chamber of a double diaphragm pump.

18. The device according to claim 17, wherein the ink feed chamber has a volumetric capacity that is equal to or greater than a volumetric capacity of the ink return chamber.

19. The device according to claim 14, wherein a volume of the feed ink that is diverted from the ink feed line is such that the flow rate ratio corresponds to a volume pumped by the pumping devices.

20. A device that delivers ink to and from a closed squeegee device of a rotary printing unit inking system, comprising:

a double diaphragm pump including an ink feed chamber and an ink return chamber in which a flow rate ratio between the ink feed chamber and the ink return chamber is fixed;

a first bypass line configured to controllably divert from an ink feed line that feeds the ink to the squeegee device a portion of the feed ink, the first bypass line departing from the ink feed line on a discharge side of the ink feed chamber and communicating the diverted feed ink without supplemental pumping thereof to an ink tank that is in communication through an ink suction line with a suction side of the ink feed chamber; and a second bypass line configured to controllably divert from an ink return line that removes the ink from the squeegee device a portion of the return ink, the second bypass line departing from the return line on a discharge side of the ink return chamber and communicating the diverted return ink to the ink feed line at a location between the first bypass line and the squeegee device.

21. The device according to claim 20, further comprising a throughflow regulating valve and/or a cutout valve provided in at least one of the ink feed line, the first bypass line, and the second bypass line.

22. The device according to claim 21, further comprising a sensor that monitors a quantity of the ink present in the squeegee device and signals a control circuit that regulates the throughflow regulating valve such that the quantity of ink in the squeegee device is maintained within a specified limit.

23. A process for supplying printing ink to and educing printing ink from a squeegee device of an inking system on a rotary printing press that has a squeegee blade carrier, provided with a longitudinally running trough, with squeegee blades that are adjustable on a form inking roller or on an anilox roller, which, together with the form inking roller and the trough provide an ink chamber, and has lines and first and second pumping devices powered by motors for supplying and educing the ink to and from the ink chamber, comprising:

presetting pump operational parameters of the motors such that a flow rate ratio between the first pumping device and the second pumping device is fixed and on demand diverting from an ink feed line that feeds the ink from an ink tank to the squeegee device a portion of the feed ink and/or diverting from an ink return line that removes the ink from the squeegee device a portion of the return ink, the feed ink being diverted through a bypass line that departs from the feed line and leads directly to the ink tank; and regulating flow with a throughflow regulating valve provided in the bypass line.

24. The process in accordance with claim 23, wherein the return ink is diverted through a bypass line that departs from the return line and connects to the feed line of the squeegee device.

* * * * *